US005099627A

United States Patent [19]

Coulton et al.

[11] Patent Number: 5,099,627

[45] Date of Patent: Mar. 31, 1992

[54] VENTILATED ROOF CONSTRUCTION AND METHOD

[75] Inventors: Michael S. Coulton, Horsham; Curt A. Cyliax, Chalfont, both of Pa.; Geoffrey N. Ehrman, South Windsor, Conn.

[73] Assignee: Benjamin Obdyke Incorporated, Warminster, Pa.

[21] Appl. No.: 589,705

[22] Filed: Sep. 28, 1990

[51] Int. Cl.[5] ..... E04B 7/00

[52] U.S. Cl. ..... 52/408; 52/518; 52/540; 52/746; 52/747

[58] Field of Search ..... 52/404, 407, 408, 409, 52/410, 481, 483, 303, 746, 747, 540, 518; 156/183

[56] References Cited

U.S. PATENT DOCUMENTS

| | | | |
|---|---|---|---|
| 709,257 | 9/1902 | Cottrell | 220/DIG. 9 |
| 2,030,668 | 2/1936 | Weyerhaeuser et al. | 52/481 |
| 2,096,784 | 11/1937 | Candler | 108/7 |
| 2,541,762 | 2/1951 | Heritage | 52/481 |
| 2,774,126 | 12/1956 | Secrist | 156/183 |
| 2,897,109 | 7/1959 | Voigtman | 156/183 |
| 3,125,479 | 3/1964 | Finan | 156/300 |
| 3,135,069 | 6/1964 | Schuller et al. | 50/196 |
| 3,204,379 | 9/1965 | Osborn | 52/303 |
| 3,546,843 | 12/1970 | Luebs | 52/540 |
| 3,746,604 | 7/1973 | Reynolds | 161/69 |
| 3,892,899 | 7/1975 | Klein | 52/746 |
| 4,315,392 | 2/1982 | Sylvest | 52/309.1 |
| 4,385,477 | 5/1983 | Walls et al. | 52/404 |
| 4,538,388 | 9/1985 | Friesen | 52/199 |
| 4,669,246 | 6/1987 | Freeman | 52/408 |
| 4,805,367 | 2/1989 | Kleckner | 52/408 |
| 4,969,302 | 11/1990 | Coggan et al. | 52/540 |

FOREIGN PATENT DOCUMENTS

| | | | |
|---|---|---|---|
| 486483 | 9/1952 | Canada | 52/809 |
| 1081205 | 5/1960 | Fed. Rep. of Germany . | |
| 2186898 | 2/1986 | United Kingdom . | |

*Primary Examiner*—James L. Ridgill, Jr.
*Attorney, Agent, or Firm*—Robert C. Podwil

[57] ABSTRACT

A building structure of particular utility in wooden roof structures comprises an inner sheathing member, a membrane affixed to and overlaying the inner sheathing member, and an openwork member overlaying the membrane and supporting shingles away from the inner sheathing member. A method of installing a wooden roof structure so as to retard deterioration due to entrapped moisture involves affixing to a deck a layer of roofing felt, positioning over the felt an openwork matrix leaving multiple vapor flow paths therethrough, and affixing over the matrix a layer of shingles.

17 Claims, 1 Drawing Sheet

FIG. 1
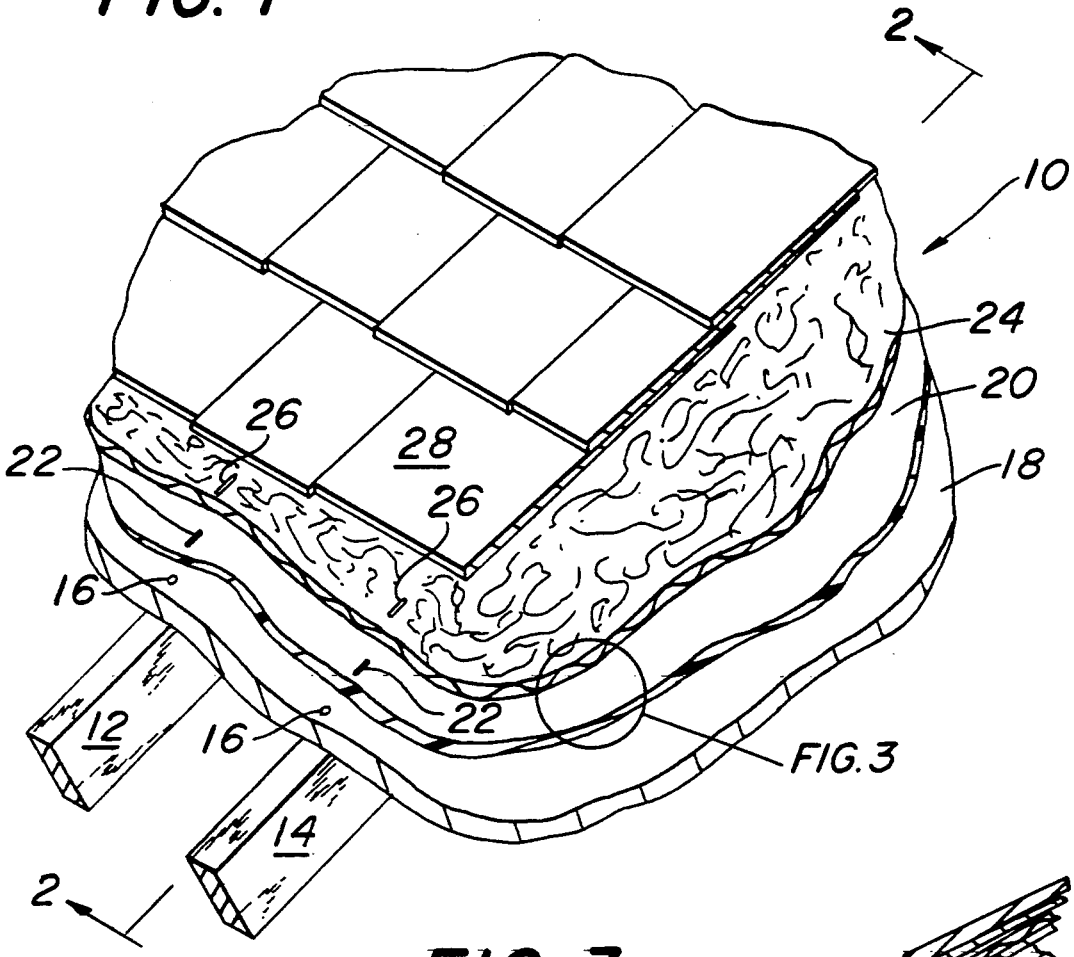
FIG. 3
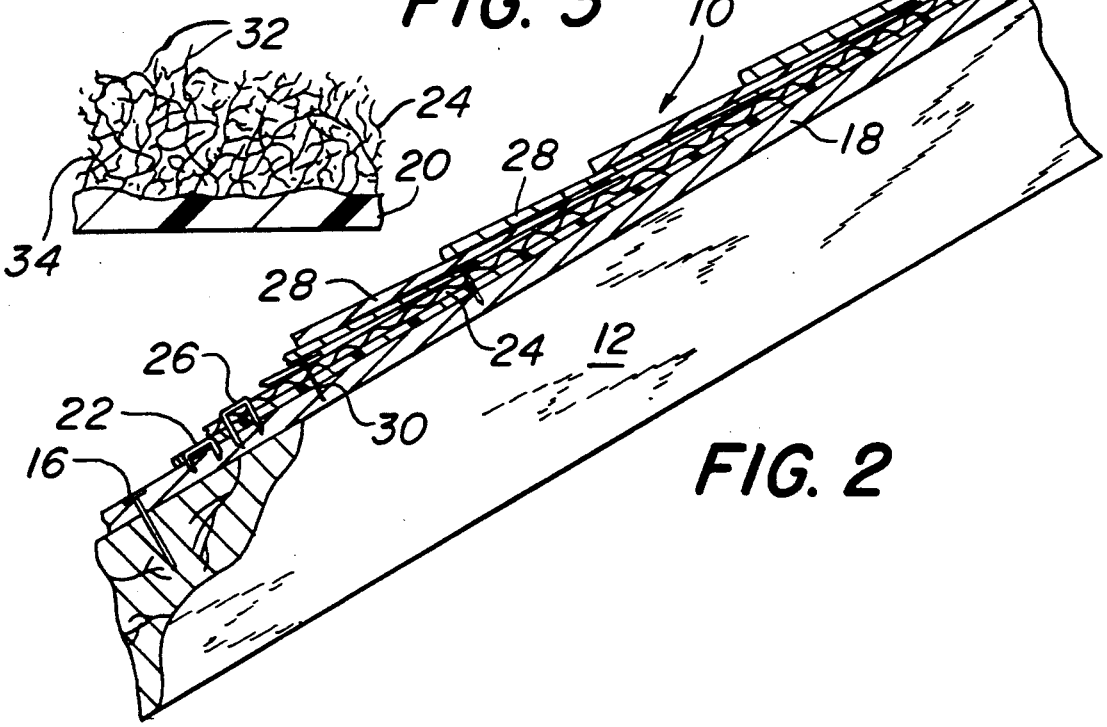
FIG. 2

VENTILATED ROOF CONSTRUCTION AND METHOD

BACKGROUND OF THE INVENTION

1. Field of the Invention

This invention relates to roof constructions and methods of making them, and more particularly, to built-up roof constructions of the shingled-type and which allow for air circulation beneath the shingles to forestall deterioration. The invention has particular utility and applicability to roofs (and the making of roofs) using wooden shingles, such as cedar shakes, applied over wooden or wood-based sheathing.

2. Description of the Prior Art

It is well known that moisture from the interior of a building structure, as well as water leaking through the outer structure of a built-up roof construction, may accumulate in the roof structure and cause rapid deterioration and ultimately failure. The problem of accumulated moisture is especially serious in roofs using potentially biodegradable materials, such as wooden shingles.

In conventional high quality wooden roof constructions, one by three inch furring strips are applied, in spaced rows about five inches apart, to the sheathing or decking, typically plywood or particle board, in a direction transverse to the pitch of the roof. The shingles, such as cedar shakes, are applied to the furring strips and spaced from the sheathing or decking by the thickness of the strips. Thus, the furring strips serve to space the shingles from the sheathing and allow the structure to "breathe" in the sense of allowing for the circulation of air beneath the shingles to remove moisture.

Because the application of furring strips is time consuming and relatively exacting work, many wooden shingled roofs are currently being made with shakes applied directly to the decking, in a manner which precludes or at least greatly impedes the circulation of air beneath the shakes. Such constructions encourage the shakes to rot, and accelerate roof failure. Indeed, common understanding in the building industry is that a wooden roof in which the cedar shakes are applied directly to the sheathing has a life expectancy of only seven to eight years.

Ventilated built-up roof constructions have heretofore been proposed.

U.S. Pat. No. 4,538,388, issued Sept. 3, 1985, to Friesen, discloses a roof structure which uses a plastic film and spaced vents to allow for ventilation of water vapors within or seeking entry to the roof system.

U.S. Pat. No. 4,805,367, issued Feb. 21, 1989, to Klechner, suggests a circulation enhancing support between a roof deck and roof insulation, the support being a screen or grid-like structure made up of regular sets of spaced apart undulating elements joined with other such elements, as by welding.

U.S. Pat. No. 4,315,392, issued Feb. 16, 1982, to Sylvest, discloses a built up roof, which comprises sheathing, over which is disposed a roof covering sheet material spaced from the sheathing, and a spacing means made up of a mat of resilient nonwoven wires, threads or fibers of high air volume.

Many other ventilated roof constructions and roofing materials have been proposed.

SUMMARY OF THE INVENTION

It is a principal object of this invention to provide a durable and long-lasting ventilated roof construction which can be made from easily handled and stored materials, typically available in roll form, and which can readily be installed with a minimum of skilled labor. Although they are described and illustrated principally in relation to a roof construction, and have their greatest utility and advantage there, it will be understood that the principles of the present invention may be applied to other specific building structures.

The invention provides, in its apparatus aspect, a building construction which allows for the passage of vapors from within the structure, specifically to retard deterioration of the structure due to accumulated moisture. The structure comprises, in a presently preferred form of the invention, an inner sheathing member, perhaps of plywood, providing a wall of the structure. A membrane capable of accommodating minor dimensional changes due to heating, cooling, settling and yielding of the structure, is affixed to and overlies the sheathing. A membrane of this sort is typically made of roofing felt or other like material. An openwork member overlies the membrane and is affixed to the sheathing.

In a preferred form of the invention, the open work member is made up of a resilient matrix of matted self-supporting filaments, preferably of plastic polymeric material, resistant to degradation in the roof environment. The filaments of the openwork member are preferably randomly convoluted, and joined together at points of contact. The preferred thickness (depth) of the matrix in an undeformed state is a minimum of approximately $\frac{1}{4}$ inch, and the filaments are formed of nylon in the preferred embodiment with a diameter of approximately 0.020 inches. Material of the above kind, like the roofing felt mentioned above, may be provided in roll form for ease of handling and installation.

In its method aspect, the invention provides a technique for creating a shingled wooden building structure with a minimum of skilled labor. In accordance with the method, installation of a wooden building structure comprises the steps of providing a deck member or substrate, applying and affixing to the deck or substrate a layer of roofing felt, positioning over the felt a resilient openwork matrix providing multiple vapor flow paths therethrough, and positioning over the matrix and affixing to the deck or substrate a layer of shingles. The matrix may be applied as a series of strips, the strips being positioned side by side or edge to edge.

The above apparatus and method are particularly applicable to roofs using cedar shake shingles.

DESCRIPTION OF THE DRAWINGS

There is seen in the drawings a form of the invention which is presently preferred (and which represents the best mode contemplated for carrying the invention into effect), but it should be understood that the invention is not limited to the precise arrangements and instrumentalities shown.

FIG. 1 is a perspective view, partially broken away, of a portion of a roof construction made in accordance with the invention.

FIG. 2 is a cross-sectional view, taken along the line 2—2 in FIG. 1; and FIG. 3 is a partial detail view taken as indicated in FIG. 1.

Referring now to the drawings in detail, wherein like reference numerals indicate like elements, there is seen in FIG. 1 a building structure designated generally by the reference numeral 10. As is apparent, the illustrated building structure is, more specifically, a roof structure.

The structure 10 comprises a pair of rafters 12 and 14, to which there is affixed, by nails 16 or other suitable and conventional means, a deck member 18. The deck member 18 is typically made of plywood, but may also, in some applications, be of particle board or other materials as the design and local building codes may permit.

A layer of roofing felt 20 overlies the deck member 18 and is secured to it by convenient fastening means, such as the illustrated staples 22. The staples 22 are applied at suitably spaced intervals so as to securely fasten the felt 20 to the deck member 18 and to maintain it flush with the deck.

Placed above the roofing felt 20 and secured to the deck member 18 is an openwork member 24, which is described in detail below. As is perhaps best seen in FIG. 2, Staples 26 may be used to fasten the openwork member 24 to the deck member 18.

Shingles 28 overlie the openwork member 24, and are affixed to the deck member 18 by roofing nails 30 or other conventional means, seen in FIG. 2. The nails 30, it will be appreciated, extend through the openwork member 24 and roofing felt 20 to the deck member 18.

It should now be apparent that the openwork member 24 serves to space the shingles 28 from the deck member 18, and to facilitate the flow of vapor between them.

Referring now to FIGS. 1 and 2, the openwork member 24 is a matrix, preferably constructed of a matting of individual filaments formed of a plastic polymeric material, resistant to degradation in the environment of a building structure, and, further, randomly convoluted. It is also preferable that the matrix of the openwork member 24 have a thickness of approximately ¼ inch. The filaments may be formed of nylon, it has been found, with a diameter of approximately 0.020 inches.

The matrix, in accordance with the above, is self-supporting, and provides multiple relatively open flow paths therethrough. It is characterized by having a composite strength in compression sufficient to support the weight of the overlying shingles 28 without collapsing, and, preferably, by resilience sufficient to restore the openwork member 24 to substantially its original thickness in the event that it is temporarily depressed during or after installation.

The openwork member 24 is preferably provided as roll stock, to facilitate its transportation to a job site and its handling during the installation process. In the presently preferred form of the openwork member 24, the matrix material is provided in a roll of approximately 36 inches in width and 33 or 66 feet in length. In its presently preferred form, the matrix of which the openwork member 24 is made is smooth or substantially smooth on one side to enable the matrix to abut fairly uniformly the roofing felt 20.

Referring to FIG. 3, the matrix defined by the openwork member 24 thus comprises a matting of randomly convoluted filaments or wires 32, joined at points 34 at which they abut, to provide in the aggregate a resilient characteristic. The desired properties may be achieved through the use of nylon filaments, such as the illustrated filaments 32.

Nylon, as is well known, is a thermoplastic polyamide resin, the filaments of which may be heat fused to one another at randomly spaced points (indicated in FIG. 3 by the reference numeral 34). The randomly convoluted and mutually interconnected filaments 32 are advantageously formed by extrusion of molten polymer through articulated spinerets. U.S. Pat. Nos. 3,687,759, 3,691,004 and 4,212,692 teach methods and apparatus for forming matrices of the kinds employed in the openwork member 24 of the present invention, albeit for purposes unrelated to the specific application involved here.

In one presently preferred embodiment of the openwork member 24, the matrix has a thickness of approximately ¼ inch and the diameter of the nylon filaments is approximately 0.020 inches. Further, it has been found that the incorporation into the individual filaments 32 of approximately 0.5% carbon black by weight, in filaments of "Nylon 6", inhibits degradation of the polymeric material by ultraviolet radiation, a consideration in roofing applications.

The method of making a building structure 10 in accordance with the present invention will now be described in detail.

As indicated above, the material from which the openwork member 24 may be made is flexible, so that it may readily and conveniently stored and transported in roll form. The roofing felt 16, too, is available and usually provided in roll form.

A building structure 10 in accordance with the invention may be made first providing an inner wall member such as the deck member 18, and then applying and affixing to the deck member 18, as by staples 22 or other suitable fasteners, a layer of roofing felt 20. Next, the openwork member 24 is positioned over the roofing felt 20, and secured to the deck member 18 through the felt 20.

Next, an outer wall element, in the illustrated form the shingle 28, is positioned over the openwork member 24 and affixed to the deck member 18 by nails or the like.

As is seen in FIG. 1, the openwork member 24 may be made up of a series of strips of the above-described matrix material, positioned side by side to create the needed area.

The present invention may be embodied in other specific forms without departing from its spirit and essential attributes, and, accordingly, reference should be made to the appended claims rather than the foregoing specification as indicating the scope of the invention.

What is claimed is:

1. A building structure adapted to allow for ventilation of vapors from within the structure so as to retard deterioration of the structure, comprising: an inner sheathing member providing a wall of a building structure; a membrane affixed to and overlying said inner sheathing member; an openwork member overlying said membrane and affixed to said inner sheathing member, said openwork member having multiple vapor flow paths therethrough; and an outer sheathing member overlying said openwork member and affixed to said inner sheathing member, said openwork member serving to space said outer and said inner sheathing members and to provide for the flow of vapor therebetween.

2. A building structure in accordance with claim 1, wherein said inner sheathing member is a roof deck, and said outer sheathing member comprises a layer of shingles.

3. A building structure in accordance with claim 2, wherein said shingles are wooden.

4. A building structure in accordance with claim 3, wherein said membrane comprises a layer of roofing felt, said roofing felt providing a surface adapted to conform to abut with and support said openwork member.

5. A building structure in accordance with claim 4, wherein said shingles are cedar shakes.

6. A building structure in accordance with claim 2, wherein said openwork member comprises a resilient matrix of matted self-supporting filaments.

7. A building structure in accordance with claim 6, wherein said shingles are wooden.

8. A building structure in accordance with claim 7, wherein said shingles are cedar shakes.

9. A building structure in accordance with claim 7, wherein said membrane comprises of a layer of roofing felt, said roofing felt providing a surface adapted to conform to in contour and to support said openwork member.

10. A building structure in accordance with claim 9, wherein said openwork member comprises a resilient matrix of self-supporting filaments.

11. A building structure adapted to allow for venting of vapors from within the structure to retard deterioration of the structure due to entrapped moisture, comprising a wooden roof deck; a sealing layer comprising a layer of roofing felt affixed to and overlying said deck; shingles affixed to said deck and overlying said sealing layer and said structure; and a resilient openwork spacer member overlying said sealing layer and spacing said shingles from said deck to vent moisture from beneath said shingles, said openwork member having multiple gas flow paths therethrough.

12. A roof structure in accordance with claim 11, wherein said spacer member comprises a matrix of self-supporting randomly convoluted polymeric filaments, said matrix having a thickness of about $\frac{1}{4}$ inch.

13. A roof structure in accordance with claim 11, wherein the filaments of said spacer member have a diameter of approximately 0.020 inch.

14. A method of installing a wooden roof structure so as to retard deterioration of the roof due to entrapped moisture, the roof structure having a roof-supporting deck, comprising the steps of: applying and affixing to the deck a layer of roofing felt, positioning over the felt a resilient openwork matrix providing multiple vapor flow paths therethrough, and positioning over the matrix and affixing to the deck a layer of shingles.

15. A method in accordance with claim 14, and the further step of affixing the matrix to the deck before applying over the matrix a layer of shingles.

16. A method in accordance with claim 14, wherein the matrix is applied as a series of strips, and said step of positioning the matrix is so performed as to place the strips in edge-to-edge relationship.

17. A method in accordance with claim 16, characterized in that the shingles affixed over the matrix are wooden.

* * * * *